US006106096A

United States Patent [19]

Komplin et al.

[11] Patent Number: 6,106,096

[45] Date of Patent: Aug. 22, 2000

[54] PRINTHEAD STRESS RELIEF

[75] Inventors: Steven Robert Komplin; Ashok Murthy; Michael Raulinaitis; Gary Raymond Williams, all of Lexington, Ky.

[73] Assignee: Lexmark International, Inc., Lexington, Ky.

[21] Appl. No.: 08/990,343

[22] Filed: Dec. 15, 1997

[51] Int. Cl.[7] ..... B41J 2/015; B41J 2/135

[52] U.S. Cl. ..... 347/20; 347/44

[58] Field of Search ..... 347/20, 44, 45

[56] References Cited

U.S. PATENT DOCUMENTS 4,994,825 2/1991 Saito et al. ..... 346/140 R 5,847,725 12/1998 Cleland et al. ..... 347/20

*Primary Examiner*—John Barlow

*Assistant Examiner*—Michael S. Brooke

*Attorney, Agent, or Firm*—Michael T. Sanderson

[57] ABSTRACT

The invention described in the specification relates to an ink jet printhead structure having semiconductor substrate containing energy imparting devices for ejecting ink through nozzle holes in a nozzle plate, to a method for making a printhead structure and to a printer cartridge containing the printhead structure. In order to reduce stresses induced in the structure during manufacturing and/or use thereof, a polymeric layer is disposed between the semiconductor substrate and nozzle plate which contains expansion void spaces or valleys sufficient to inhibit stresses in the structure during a process for bonding the nozzle plate to the polymeric layer thereby reducing misalignment and warpage problems associated with conventional printhead structures.

15 Claims, 3 Drawing Sheets

(VIEW A–A)

PRINTHEAD STRESS RELIEF

FIELD OF THE INVENTION

The invention relates to an improved printhead design for an ink jet printer and to a method for reducing thermal and/or mechanical stress in a composite printhead structure.

BACKGROUND OF THE INVENTION

Ink jet printheads are composite structures which are conventionally made by bonding a nozzle plate to a semiconductor substrate either directly using an adhesive or by bonding the nozzle plate to a polymeric layer which is deposited on or bonded to the substrate. The polymeric layer may be patterned before or after bonding to the substrate in order to provide ink flow features which provide ink to the regions of the printhead which induce the ink to be expelled through the nozzle plate to a print media.

In order to bond a nozzle plate to the polymeric layer, heat and pressure are applied to the nozzle plate and substrate. Because each of the nozzle plate, polymeric layer, and substrate material often have a different modulus of elasticity and coefficient of thermal expansion, the materials of the printhead composite tend to expand and contract at different rates and by different amounts when heated and/or cooled. The uneven expansion and/or contraction of the components during the bonding process induce stresses which warp the components thereby causing misalignment and stresses which increases the tendency for the components to fracture during assembly and use of the printhead. Component misalignment and/or warpage may result in misfiring of the printhead or in ink being misdirected from the printhead.

As the number of nozzle holes increases and the size of the holes decreases, the criticality of component alignment becomes substantially more important for the proper functioning of the printer. Printhead structures which are warped or which contain components which are not aligned properly result in significantly reduced printer performance and quality.

An object of the invention is to improve component alignment in a printhead structure.

Another object of the invention is to reduce thermal stresses in print head components during assembly thereof.

A further object of the invention is to provide a less costly manufacturing process for printhead components which induces relatively less thermal stresses in the components parts thereof.

SUMMARY OF THE INVENTION

With regard to the above and other advantages, the invention provides a printhead composite structure including a semiconductor substrate containing energy imparting devices for ink and electrical tracing connected thereto on a surface of the substrate, a thick film polymeric layer adjacent the energy imparting surface of the substrate and a nozzle plate attached to the polymeric layer. The polymeric layer has a sufficient thickness and size suitable for containing a plurality of ink chambers and ink flow channels and a plurality of valleys in an area of the polymeric layer adjacent the ink chambers, which valleys are sufficient to inhibit thermally induced stresses in the polymeric layer during a process for bonding the nozzle plate to the polymeric layer.

In another embodiment, the invention provides a method for making an ink jet printhead which comprises providing a semiconductor substrate containing electrical tracing connected to energy imparting devices for ink on a surface of the substrate, applying a polymeric layer onto the surface of the semiconductor substrate, the polymeric layer having a thickness ranging from about 2 to about 50 microns, preferably from about 10 to about 30 microns, treating the polymeric layer in one or more steps to provide ink chambers and ink flow channels therein for flow of ink to the energy imparting devices and to produce valleys adjacent the ink chambers, and bonding a nozzle plate adjacent to the polymeric layer using heat thereby forming an ink jet printhead, wherein the valleys are of a size and located in an area of the polymeric layer sufficient to minimize thermal stresses in the polymeric layer during the bonding process.

In yet another embodiment, the invention provides a thermal ink jet printer cartridge which comprises an ink reservoir body, electrical contacts for connecting the cartridge to a printer and a printhead structure attached to an electrical tab circuit containing the contacts, wherein the printhead structure comprises a semiconductor substrate having thermal resistance elements and electrical traces on a ink wettable surface thereof and an ink via therethrough, a photoresist thick film polymeric layer attached adjacent the ink wettable surface of the substrate and a nozzle plate attached to the polymeric layer wherein the polymeric layer contains a multiplicity of ink flow channels leading from an inlet ink region to ink chambers adjacent the inlet ink region. The polymeric layer also contains a plurality of voids in an area of the polymeric layer adjacent the ink chambers, the voids having a size sufficient to inhibit thermal stresses in the printhead structure during a manufacturing process therefor.

While the invention has particular applicability to printhead structures having metal nozzle plates, the invention may also be advantageously employed with printhead structures having polymer or other nozzle plates, for example. The invention may find use wherever the nozzle plate, the polymeric layer and/or the substrate material each have a different modulus of elasticity and coefficient of thermal expansion.

An advantage of the invention is that the valleys or voids, which provide reduced thermal stresses during the process of bonding the nozzle plate to the polymeric layer, are formed in the polymeric layer rather than in the nozzle plate thereby simplifying the manufacturing process. Furthermore, the valleys or voids may be produced at the same time or substantially the same time as the production of other flow features in the thick film or polymeric layer, thereby reducing the number of process steps as compared to producing a metal or metal coated nozzle plate and forming the valleys or voids in the nozzle plate using a separate machining step.

BRIEF DESCRIPTION OF THE DRAWINGS

Further advantages of the invention will become apparent by reference to the detailed description of preferred embodiments when considered in conjunction with the following drawings, which are not to scale so as to better show the detail, in which like reference numerals denote like elements throughout the several views, and wherein.

DETAILED DESCRIPTION OF THE INVENTION

Figure 1:
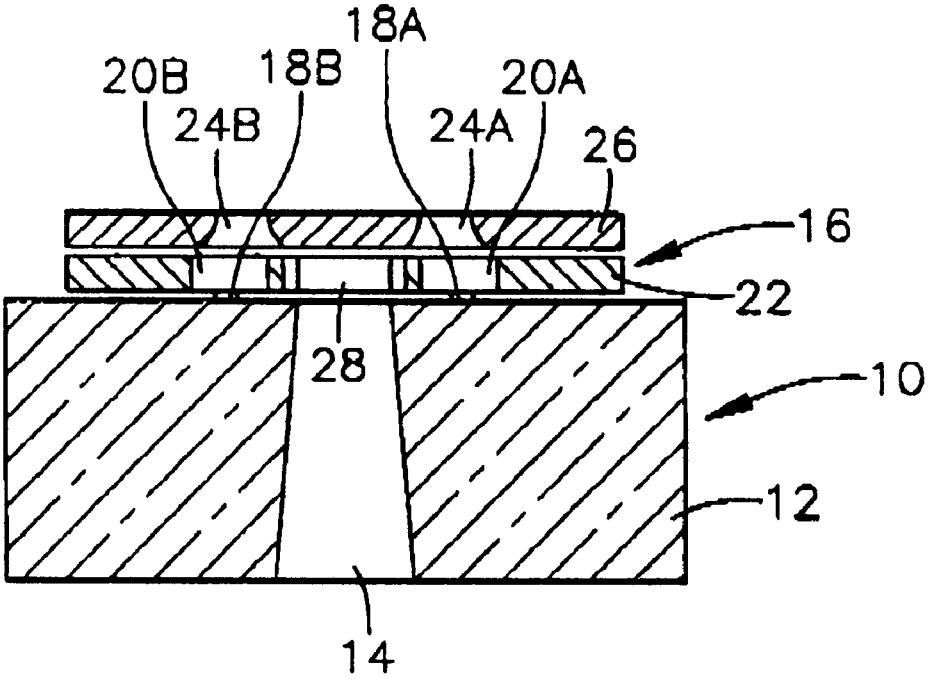
FIG. 1 is a cross-sectional view from one end of a printhead structure according to the invention through ink flow regions of the structure.

Referring now to the figures, FIG. 1 is an cross-sectional view from one end of a printhead composite structure 10 according to the invention. The printhead structure 10 includes a semiconductor substrate 12, preferably a single crystal silicon substrate, which may contain an ink flow passage or via 14 for flow of ink from an ink reservoir to the energy imparting region of the printhead, generally designated as 16. The invention is not limited to flow of ink from a central via in the substrate, as the ink may also be caused to flow around the edges of the substrate into the energy imparting region of the printhead. The energy imparting region 16 preferably contains resistance heaters 18A and 18B or other energy imparting devices for inducing ink which has accumulated in ink chambers 20A and 20B to be expelled through nozzle holes 24A and 24B in a nozzle plate 26.

The semiconductor substrate 12 is preferably a single crystal silicon substrate which is defined as one of a plurality of individual substrates on a silicon wafer. As described the silicon wafer may be patterned to provide ink vias 14 in each of the substrates for flow of ink from a reservoir to an ink wettable surface of the substrate. Electrical tracing and contacts are also deposited on the individual substrates to provide electrical connection between the energy imparting devices such as resistance heaters 18A and 18B and a printer controller. In order to provide suitable ink flow features, a polymeric layer 22 is preferably deposited or attached to the wafer so that flow features for the individual printhead structures can be patterned therein.

The flow features provided in the polymeric layer 22 include ink chambers 20A and 20B and associated flow channels which are formed in a central region of the polymeric layer 22 so that ink flow channels are in flow communication with the ink chambers 20A and 20B and a central ink inlet region 28 which is in flow communication from central ink via 14 in the substrate. In the case of ink flow around the edges of the substrate, the ink flow channels are positioned near the edges of the polymeric layer 22 and the central ink inlet region 28 is not required. For simplicity, the printhead structures will be described with reference to a single printhead structure on the wafer. However, it will be understood that multiple printhead structures are preferably formed at one time on the silicon wafer and once the structures are complete, they are removed from the wafer and attached along with the polymeric layer to a printhead region of a printer cartridge.

The polymeric layer 22 may be a single or multiple polymeric layer, each layer being a photoimageable polymeric material selected from positive and negative photoresist materials such as polydimethylglutarimide (PMGI)-based photoresists, polymethylmethacrylate (PMMA)-based photoresists, PMGI-PMMA copolymer photoresists, phenol-formaldehyde-type photoresists and photodecomposable polymeric compounds derived from vinylketone, or a laser ablatable material such as polyimide. The polymeric layer 22 may be adhesively bonded to the substrate 12 as a dry film or may be coated onto the substrate 12 from a solution using spin-coating techniques. A B-stageable adhesive may be used as the polymeric layer or as an adhesive layer to adhesively bond the polymeric layer and nozzle plate to one another.

It is preferred to pattern the polymeric layer 22 with the flow features after the layer is applied to the substrate 12, however, the invention is not limited to patterning the layer 22 after it is applied to the substrate, nor is the invention limited to a single polymeric layer. Multiple polymeric layers 22 comprised of the same or different materials may be used to provide the flow features and other aspects of the invention.

In order to pattern a polymeric layer 22 made of a photoresist material, the layer is exposed to a light or electron beam radiation source, preferably an ultraviolet light source through a mask in a pattern which defines the ink chambers 20A and 20B, the ink inlet region 28 and the ink flow channels. After exposing the polymeric layer 22 to light sufficient to cure defined areas of the layer 22, the uncured portions of the layer are removed by dissolving the uncured portions in a suitable solvent such as a butylcellosolve acetate/xylene mixture. When a polyimide material is used as the polymeric layer 22, the polyimide is preferably ablated through a mask using a laser beam source sufficient to remove portions of the polyimide material thereby defining the flow features of the layer 22. The flow features may also be patterned on a dry film polymeric layer 22 before the layer is aligned with and fixedly attached to the substrate 12.

Once the polymeric layer 22 is patterned, a nozzle plate 26 is bonded to the polymeric layer 22. The nozzle plate 26 is preferably provided by a gold or a gold-plated nickel material which contains a plurality of nozzle holes therein. The nozzle holes align with the flow features patterned into the polymeric layer 22 in order to provide conduits to direct ink from the ink chambers 20A and 20B to print media. The nozzle holes typically have an entrance diameter of about 43 microns on the polymeric layer side of the nozzle plate to an exit diameter of about 29 microns on the print media side of the nozzle plate. A typical nozzle plate may contain from about 50 to about 100 nozzle holes or more. Considering that the nozzle plate 26 has a length of from about 6 to about 25 millimeters and a width of from about 2 to about 40 millimeters, preferably from about 3 to about 20 millimeters, it will be appreciated that even slight misalignment or warpage of the nozzle plate may have a significant impact on print quality.

During the manufacturing process, heat and pressure are applied to the nozzle plate 26 and to the polymeric layer 22 on the substrate 12 to bond the nozzle plate 26 to the polymeric layer 22. Because the substrate 12, polymeric layer 22 and nozzle plate 26 are made of different materials, they each have a unique set of thermal and mechanical properties. Most notably, the differences in modulus of elasticity and the coefficient of thermal expansion of each of the materials cause stresses in the materials due to unequal expansion and contraction of the individual components as the components are heated and cooled. Because the polymeric layer 22 is attached to the substrate 12 and the nozzle plate 26 is fixedly bonded or adhered to the polymeric layer, the stresses induced in the components by heat and pressure used for bonding the nozzle plate 26 to the layer 22, unless compensated for, may cause unwanted warpage or misalignment of the components. FIGS. 2–6 provide illustrations of the preferred methods, according to the invention, for relieving thermal stresses in the components during a manufacturing process therefor.

Figure 2:
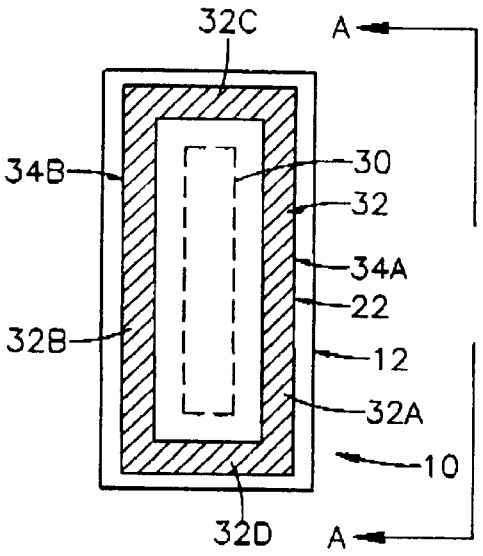
FIGS. 2 and 2A are top plan views, not to scale of printhead structures according to the invention.

FIG. 2 is a top plan view, not to scale, of a printhead structure 10 prior to attaching a nozzle plate 26 thereto which contains a semiconductor substrate 12 and a polymeric film or polymeric layer 22 attached to a surface of the substrate 12 and which illustrates the improvements according to the invention. The polymeric layer 22 is selectively thick, in that it has a thickness ranging from about 2 to about 50 microns, preferably from about 10 to about 30 microns.

As shown in FIG. 2, the polymeric layer or film 22 contains a substantially central region 30 in which flow features for ink as described with reference to FIG. 1 are contained and an outer region 32 surrounding the central region containing sufficient valleys, voids or other discontinuities which serve as expansion areas for reducing thermal stresses produced during the manufacturing process.

It is noted that in the embodiment of FIG. 2, the outer region 32 completely surrounds the central region 30 of the polymeric layer 22. However, for the purposes of this invention, at least side regions 32A and 32B adjacent the central region 30 contain valleys for reducing thermal stresses while end regions 32C and 32D need not contain such valleys. Side regions 32A and 32B are between the ink chambers 20A and 20B (FIG. 1) and the edges 34A and 34B of layer 22.

Figure 2A:
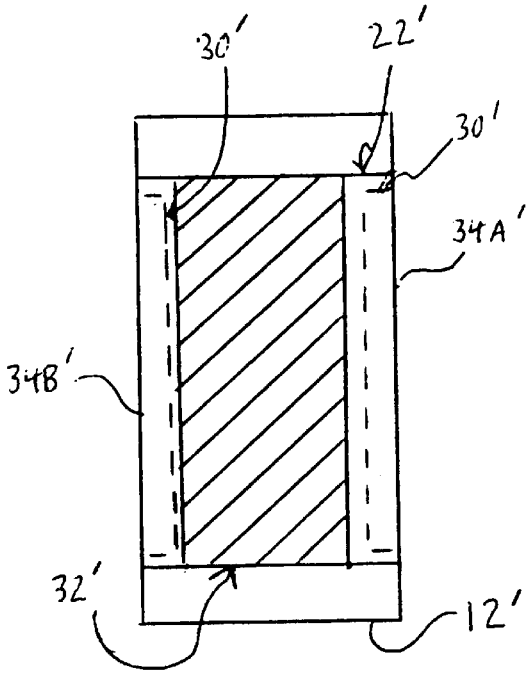

FIG. 2A illustrates an alternative embodiment of the invention wherein the ink flows to the flow features of the polymeric layer 22' from around the edges of the semiconductor substrate 12'. In this embodiment, the flow features are patterned in the polymeric layer 22' generally in outer regions 30' which extend from the edges 34A' and 34B' of the polymeric layer 22' to the vicinity of a central region 32' which contains the valleys for reducing thermal stresses during the process of bonding a nozzle plate to the polymeric layer 22'.

Figure 3:
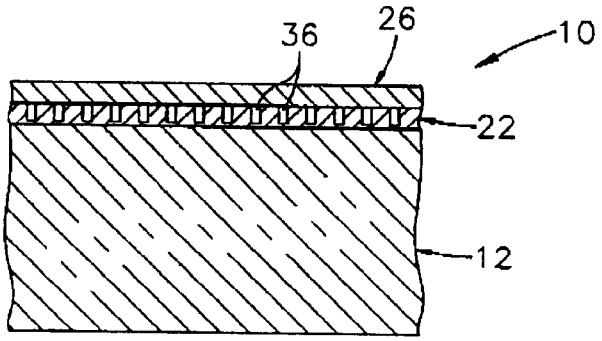
FIG. 3 is a partial side view, not to scale, of a printhead composite structure according to the invention.

A partial cross-sectional view of a side portion of a printhead composite structure 10 according to the invention along view A—A of FIG. 2 is illustrated in FIG. 3. The printhead composite structure 10 preferably includes a semiconductor substrate 12, a polymeric layer 22 attached to the substrate 12 and a nozzle plate 26 attached to the polymeric layer 22. The polymeric layer 29 preferably contains a plurality of valleys or voids 36 which inhibit thermal stresses in the structure 10 when the nozzle plate 26 is fixedly attached to the polymeric layer 22 of the structure.

Figure 5:
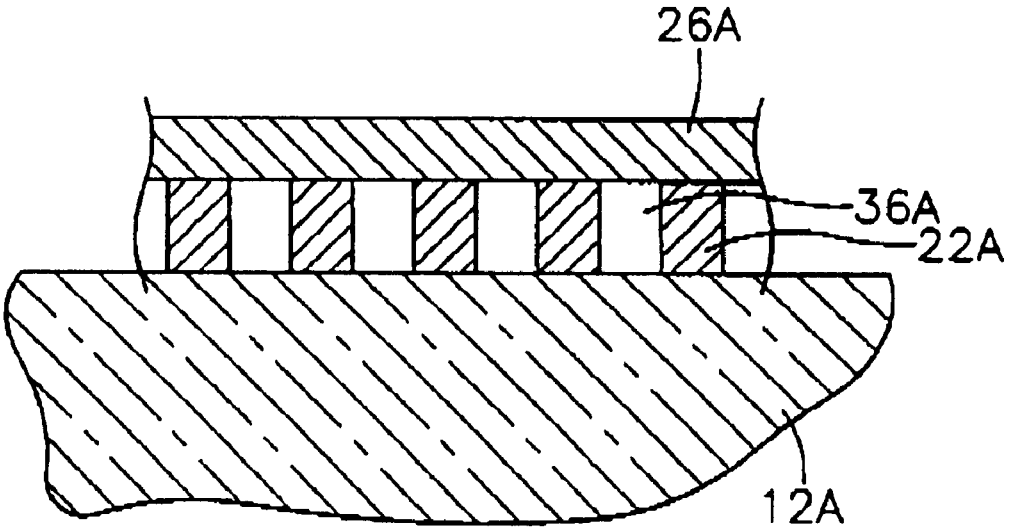
FIGS. 4 and 5 are enlarged views, not to scale, of portions of printhead composite structures according to the invention.
Figure 4:
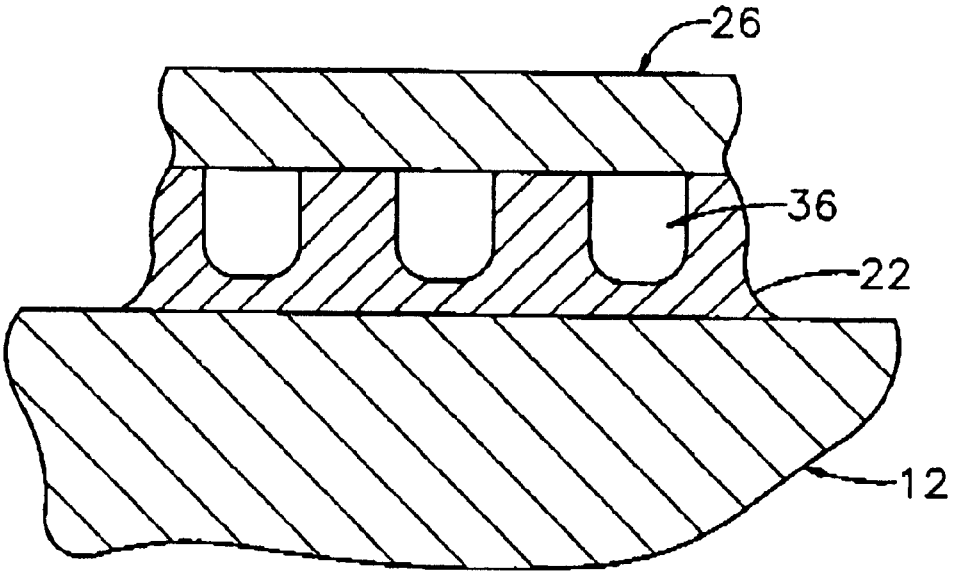

The valleys or voids 36 may be provided with a variety of shapes such as straight, curved or sloped walls, and may have a depth as thick as the polymeric layer 22 as shown in FIG. 5 (36A) or a depth that is at least 33% of the thickness of the polymeric layer 22 as shown in FIG. 4. The valleys 36 are preferably formed so that they lie substantially perpendicular to the longest dimension of side regions 32A and 32B and substantially perpendicular to the longest dimension of end regions 32C and 32D (FIG. 2).

As with the flow features, the valleys 36 may be patterned in the polymeric layer 22 either before or after applying the polymeric layer to the substrate 12. The same patterning techniques using a mask may be used to form the valleys 36 as is used to define the flow features in layer 22. In the alternative, the valleys may be mechanically abraded in the polymeric layer 22 using a grinding wheel or other abrasive device. Because the valleys are contained in the polymeric layer 22, there is no need to provide gaps or surface roughness on the nozzle plate. Accordingly, the manufacturing steps for the printhead structure are greatly simplified particularly since the valleys can be formed at the same time or substantially the same time as the other flow features in the polymeric layer 22.

As described above, the valleys 36 need not extend completely through the polymeric layer 22 to be effective. Accordingly, the depth of the valleys 36 may be controlled by selecting various aspect ratios for the valleys. The aspect ratio of a valley is defined as the greatest width of the valley divided by the thickness of the polymeric material used for the polymeric layer. For example, for a photoresist acrylate material such as LEARONAL having a thickness of about 30 microns, an aspect ratio of greater than about 18/30 will provide a valley having a depth equal to the thickness of the polymeric material. Accordingly, masks having widths of greater than 18 microns will produce valleys which extend completely through the polymeric material.

Figure 6:
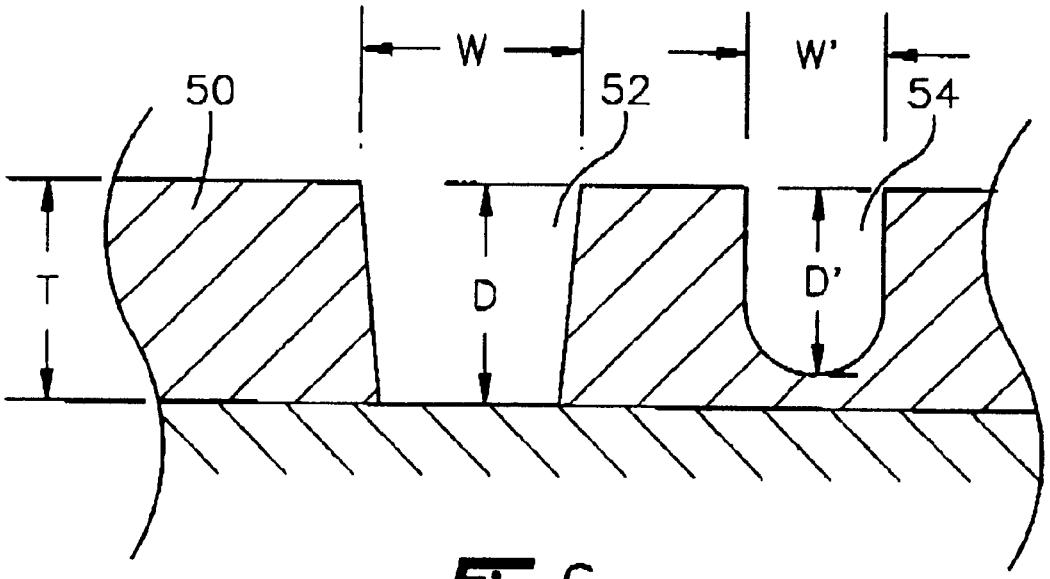
FIG. 6 is an enlarged view, not to scale, of a portion of thick film polymeric material illustrating the effect of aspect ratio on the depth of the valley formed in the polymer layer.

The relationship of aspect ratio to polymer layer thickness is illustrated by reference to FIG. 6. As shown, the polymeric layer 50 of photoresist acrylate material such as LEARONAL has a thickness T of 30 microns. For a width W of valley 52 of greater than about 18 microns, the depth D of the valley 52 is equal to the thickness T of the polymeric layer 50. However for valley 54 having a width W' of less than 18 microns, the depth D' of the valley 54 is less than the thickness T of the polymeric layer.

While the aspect ratio for the foregoing material requires an aspect ratio of less than about 18/30 in order to create a valley which does not extend all the way through the polymeric layer, the particular light source, hardware capabilities, polymeric materials and other factors may affect the aspect ratio for a particular polymeric material. Accordingly, one skilled in the art may readily determine the aspect ratio for any particular polymeric material in order to produce valleys of a desired depth.

While specific embodiments of the invention have been described with particularity above, it will be appreciated that various modifications, substitutions and additions may be made to the invention by those of ordinary skill in the art without departing from the spirit and scope of the appended claims.

What is claimed is:

1. A printhead composite structure comprising a semiconductor substrate containing energy imparting devices for ink and electrical tracing connected thereto on a surface of the substrate, a thick film polymeric layer adjacent the energy imparting surface of the substrate and a nozzle plate attached to the polymeric layer, wherein the polymeric layer has a sufficient thickness ranging from about 2 microns to about 50 microns suitable for containing a plurality of ink chambers and ink flow channels and a plurality of valleys in an area of the polymeric layer adjacent the ink chambers which valleys are of a size and located in an area of the polymeric layer sufficient to inhibit thermally induced stresses in the polymeric layer during a process for bonding the nozzle plate to the polymeric layer.

2. The printhead structure of claim 1 wherein the polymeric layer is comprised of a compound selected the group consisting of polydimethylglutarimide (PMGI)-based photoresists, polymethylmethacrylate (PMMA)-based photoresists, PMGI-PMMA copolymer photoresists, photodecomposable polymeric compounds derived from vinylketone, phenolformaldehyde type photoresists and polyimide.

3. The printhead structure of claim 1 wherein the valleys have a depth substantially equal to the thickness of the polymeric layer.

4. The printhead structure of claim 1 wherein the valleys have a depth which is at least about 33% of the thickness of the polymeric layer.

5. The printhead structure of claim 1 wherein the polymeric layer is comprised of at least two spin on polymeric layers having a total thickness ranging from about 10 to about 30 microns.

6. A thermal ink jet printer cartridge having an ink reservoir body, electrical contacts for connecting the cartridge to a printer and a printhead structure adjacent to an electrical tab circuit containing the contacts, the printhead structure comprising a semiconductor substrate having thermal resistance elements and electrical traces on an ink wettable surface thereof and an ink via therethrough, a photoresist polymeric layer having a thickness ranging from about 2 microns to about 50 microns adjacent the ink wettable surface of the substrate and a nozzle plate adjacent to the polymeric layer wherein the polymeric layer contains a multiplicity of ink flow channels leading from an inlet ink region to ink chambers adjacent the inlet ink region, and wherein the polymeric layer also contains a plurality of voids in an area of the polymeric layer adjacent the ink chambers, the voids having a depth sufficient to inhibit thermal stresses in the printhead structure during a manufacturing process therefor.

7. The cartridge of claim 6 wherein the polymeric layer is comprised of a compound selected the group consisting of polydimethylglutarimide (PMGI)-based photoresists, polymethylmethacrylate (PMMA)-based photoresists, PMGI-PMMA copolymer photoresists, photodecomposable polymeric compounds derived from vinylketone, phenolformaldehyde type photoresists and polyimide.

8. The cartridge of claim 7 wherein the voids have a depth substantially equal to the thickness of the polymeric layer.

9. The cartridge of claim 7 wherein the voids have a depth which is at least about 33% of the thickness of the polymeric layer.

10. The cartridge of claim 8 wherein the polymeric layer is comprised of at least two spin on polymeric layers having a total thickness ranging from about 10 to about 30 microns.

11. A printhead for a thermal ink jet printer comprising a semiconductor substrate containing an ink flow passage for flowing ink from an ink reservoir to an energy imparting region on the substrate, a layer of polymeric material adjacent the energy imparting region of the substrate having ink chambers, ink flow channels and an ink supply region therein cooperating with the ink flow passage to provide ink to adjacent the energy imparting region of the substrate and a nozzle plate containing nozzle holes for expelling ink from the ink chamber to print media, the nozzle plate being bonded to portions of the polymeric layer using heat and pressure, wherein the polymeric layer also contains a plurality of void spaces therein to provide discontinuities in the polymeric layer which inhibit the formation of thermal stresses in the printhead structure during bonding process.

12. The printhead of claim 11 wherein the polymeric layer is comprised of a compound selected from the group consisting of polydimethylglutarimide (PMGD-based photoresists, polymethylmethacrylate (PMMA)-based photoresists, PMGI-PMMA copolymer photoresists, photodecomposable polymeric compounds derived from vinylketone, phenol-formaldehyde type photoresists and polyimide, having an overall thickness ranging from about 2 to about 50 microns.

13. The printhead of claim 11 wherein the polymeric layer is comprised of at least two spin on polymeric layers having a total thickness ranging from about 10 to about 30 microns.

14. The printhead of claim 12 wherein the void spaces in the polymeric layer are between the ink chambers and at least two opposing edges of the polymeric layer wherein the void spaces have a depth substantially equal to the thickness of the polymeric layer.

15. The printhead of claim 12 wherein the void spaces in the polymeric layer are between the ink chambers and at least two opposing edges of the polymeric layer wherein the void spaces have a depth which is at least about 80% of the thickness of the polymeric layer.

* * * * *